US008847089B2

(12) United States Patent
Fujibayashi

(10) Patent No.: US 8,847,089 B2
(45) Date of Patent: Sep. 30, 2014

(54) SWITCH DEVICE

(75) Inventor: Mitsuyuki Fujibayashi, Kawasaki (JP)

(73) Assignee: Canon Kabushiki Kaisha, Tokyo (JP), `

( * ) Notice: Subject to any disclaimer, the term of this patent is extended or adjusted under 35 U.S.C. 154(b) by 469 days.

(21) Appl. No.: 13/327,367

(22) Filed: Dec. 15, 2011

(65) Prior Publication Data

US 2012/0160643 A1 Jun. 28, 2012

(30) Foreign Application Priority Data

Dec. 22, 2010 (JP) ..... 2010-286529

(51) Int. Cl.

| | |
|---|---|
| ***H01H 9/00*** | (2006.01) |
| ***H01H 9/18*** | (2006.01) |
| ***H01H 13/14*** | (2006.01) |
| *H01H 13/52* | (2006.01) |

(52) U.S. Cl.

CPC ..... *H01H 13/14* (2013.01); *H01H 2223/054* (2013.01); *H01H 9/181* (2013.01); *H01H 13/52* (2013.01); *H01H 2221/058* (2013.01); *H01H 2219/016* (2013.01)

USPC ..... 200/310

(58) Field of Classification Search

CPC ..... H01H 13/14; H01H 9/181; H01H 13/52; H01H 2219/016; H01H 2221/058; H01H 2223/054

USPC ..... 200/310–314, 317, 341, 5 R, 5 A, 520

See application file for complete search history.

(56) References Cited

U.S. PATENT DOCUMENTS

| | | | | |
|---|---|---|---|---|
| 4,354,077 | A * | 10/1982 | McMains et al. | 200/314 |
| 6,995,326 | B2 * | 2/2006 | Sugimura et al. | 200/5 R |
| 8,309,870 | B2 * | 11/2012 | Peterson et al. | 200/344 |

FOREIGN PATENT DOCUMENTS

| | | | |
|---|---|---|---|
| CN | 1763880 | A | 4/2006 |
| DE | 4039379 | C1 | 4/1992 |
| DE | 4401644 | A1 | 7/1995 |
| JP | 56-113376 | U | 9/1981 |
| JP | 61-049935 | U | 4/1986 |
| JP | 61-146824 | U | 9/1986 |
| JP | 01-069287 | U | 5/1989 |
| JP | 02-092618 | U | 7/1990 |
| JP | 06-050191A | A | 2/1994 |
| JP | 6-50191 | U | 7/1994 |
| JP | 2001-236847 | A | 8/2001 |
| JP | 2004-134274 | A | 4/2004 |
| JP | 2006-120491 | A | 5/2006 |
| JP | 4080322 | B2 | 4/2008 |

* cited by examiner

*Primary Examiner* — Edwin A. Leon

(74) *Attorney, Agent, or Firm* — Canon USA Inc IP Division

(57) ABSTRACT

A switch device includes a pressing portion that has a first display portion and a second display portion, a holder having at least one cell corresponding to the pressing portion, a push switch, first and second light sources that respectively illuminate the first display portion and the second display portion from behind, a plate formed with the pressing portion so as to separate, in a cell, a space between the first light source and the first display portion from a space between the second light source and the second display portion, and a regulation portion formed on both sides of the plate in the cell. In the switching device, when an operator presses the pressing portion, part of the plate presses the push switch.

13 Claims, 9 Drawing Sheets

SWITCH DEVICE

BACKGROUND OF THE INVENTION

1. Field of the Invention

The present invention relates to button switch devices equipped with display portions that are illuminated.

2. Description of the Related Art

Japanese Utility Model Laid-Open No. 6-50191 discloses a button switch. The button switch has two light sources, and the display state of the button is changed by switching the illumination states of the light sources. In this button switch, a pressing rod formed behind a pressing surface of the button switch is used to press down the top portion of a push switch to turn on the switch. In addition, in order to illuminate individual display portions with only light emitted from the corresponding light sources, a light shielding wall is formed between the two light sources.

However, the device structure of the push button disclosed in Japanese Utility Model Laid-Open No. 6-50191 is not desirably reliable. An operator will not necessarily press the center of the push button. Sometimes an off-center position of the push button is pressed. In particular, when a display on the button is changed, the operator tends to press a position where the display appears (off-center position). When the button is pressed at an off-center position, the entire push button is inclined, and accordingly, the pressing rod is also inclined. This prevents the push button from being pressed down in a direction perpendicular to the switch. For this reason, a possibility of a switch input being defective increases. In the device disclosed in Japanese Utility Model Laid-Open No. 6-50191, restoration force after the push button has been pressed down is only derived from the elastic force of the push switch. When the push button is significantly inclined and the pressing rod is moved out of the top portion of the switch, switch input is disabled and the button having been pushed down does not return to the state that existed before the button was pressed down. In addition, with regard to restoration force, the device depends on the elastic force of the push switch. For this reason, a sufficient restoration force is not obtained, or a sensation of a smooth pressing operation is not easily obtained.

SUMMARY OF THE INVENTION

The present invention is proposed in view of the above described problem. The present invention provides a switch device having high reliability and good operability.

A switch device according to the present invention includes a pressing portion having a first display portion and a second display portion, a holder having at least one cell corresponding to the pressing portion, a push switch, and first and second light sources that respectively illuminate the first display portion and the second display portion from behind. The switch device also includes a plate formed with the pressing portion so as to separate, in a cell, a space between the first light source and the first display portion from a space between the second light source and the second display portion, and a regulation portion formed on both sides of the plate in the cell. In the switch device, when the pressing portion is pressed, a portion of the plate presses the push switch.

According to the present invention, even when an operator presses an off-center position of the pressing portion, a situation in which a switch input becomes unreliable, and a pressing portion having been pressed down does not return to the state that existed before the switch was pressed down is suppressed. Since the restoration force is applied to four corners of the pressing portion, the pressing portion is pushed back without being inclined, thereby allowing a sensation of a smooth pressing operation with a switch to be obtained. Thus, the switch device having high reliability and good operability is realized.

Further features of the present invention will become apparent from the following description of exemplary embodiments with reference to the attached drawings.

DESCRIPTION OF THE EMBODIMENTS

Figure 1:
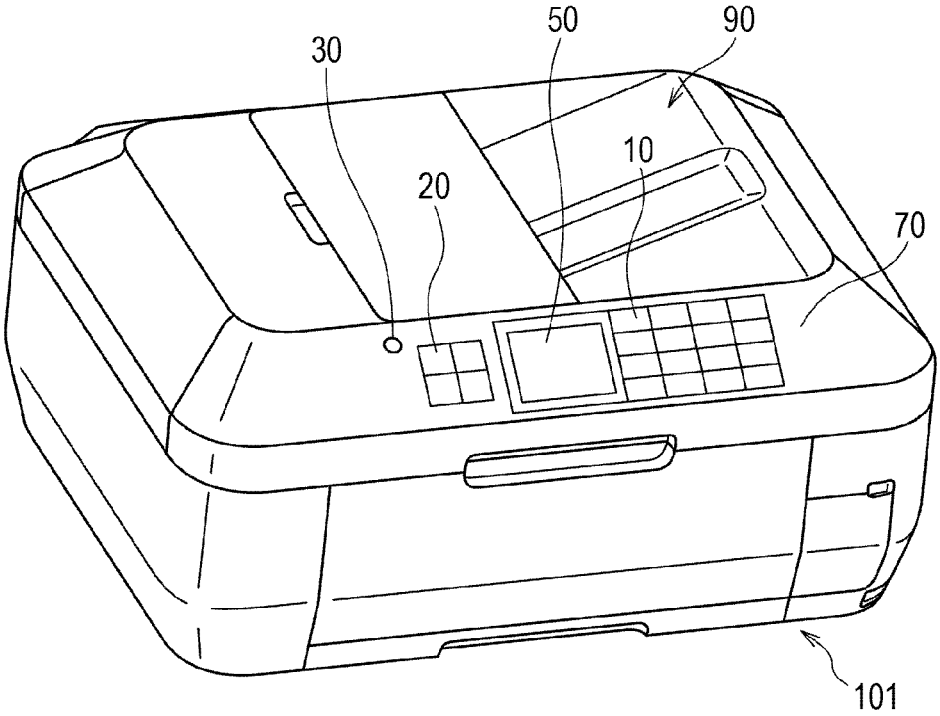
FIG. 1 is a perspective view illustrating the appearance of a multi-function printer apparatus according to an embodiment.

FIG. 1 is a perspective view illustrating the appearance of a multi-function printer apparatus having a facsimile function as an example of an electronic apparatus having a switch device. The printer apparatus includes an inkjet printing portion, a scanner portion, a facsimile portion, and so forth in a housing 101. The printer apparatus also includes a normally closed hinged pressure plate portion on its upper surface. An automatic document feeder (ADF) 90 and an operation panel 70 are disposed in the pressure plate portion. When the pressure plate portion is open, a document reading surface is exposed. In order to read a document using the scanner portion, there are two methods as follows: That is, a page of the document is moved using the automatic document feeder 90, or the pressure plate portion is opened and a page of the document is placed on the document reading surface.

The operation panel 70 includes a switch array portion 10. The switch array portion 10 includes 16 button switches in total, which are arranged in a four by four array shape. Herein, in the array shape of the switches, a lateral direction is referred to as a first direction, and a lengthwise direction is referred to as a second direction. A direction in which the buttons are pushed down and that intersects the first and second directions is referred to as a third direction. The operation panel 70 also includes a mode switch 20, a power switch 30, and a display unit 50 that uses a liquid crystal display or the like.

Figure 2:
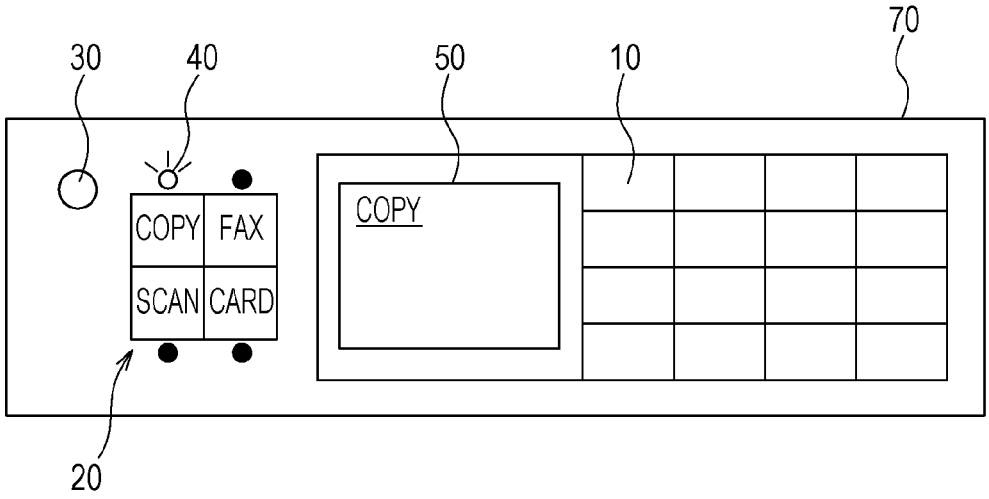
FIG. 2 is a top view of an operation panel.

FIG. 2 is a top view of the operation panel 70. The printer apparatus starts when an operator presses the power switch 30. The mode switch 20 is used to select one mode out of four modes, that is, a COPY (copy) mode, a FAX (facsimile communication) mode, a SCAN mode (reading a document) and a CARD mode (reading from a memory card). One of the modes is set when the operator presses one of four buttons of the mode switch 20. An indicator 40 is provided near each of the four buttons. The indicator 40 corresponding to a pressed one of the buttons is turned on. The mode that is set using the mode switch 20 is indicated on the display unit 50. In addition, the pattern of display in the switch array portion 10 changes in accordance with the mode that is set using the mode switch 20.

Figure 3:
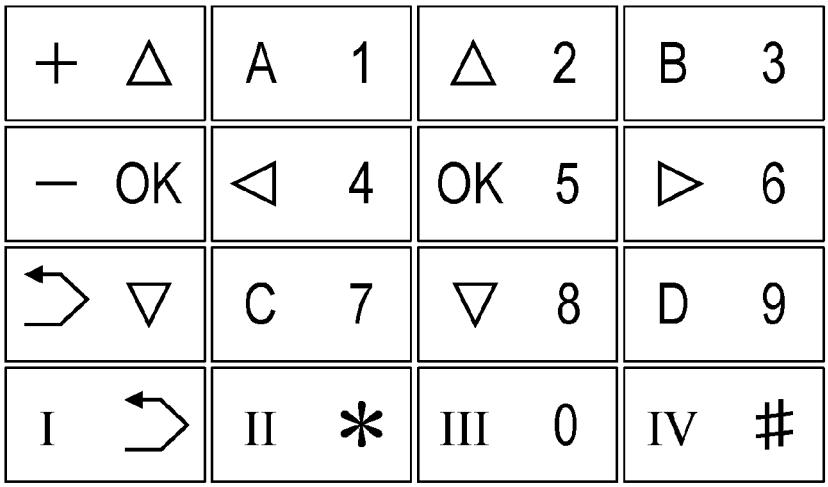
FIG. 3 illustrates all of marks that can be displayed on a switch array portion.

FIG. 3 illustrates all of marks that can be displayed on the switch array portion 10. Two marks are formed on the left and right on each button. The marks include characters, symbols, and the like. In each button, one of the marks is illuminated, or no mark is illuminated in accordance with the set mode. In order to realize this operation, each of the buttons of the switch array portion 10 includes therein a pressing portion having a display portion 1 (first display portion) on the left and a display portion 2 (second display portion) on the right, a first light source that illuminates the display portion 1 from behind, and a second light source that illuminates the display 2 portion from behind. The details of the switch structure will be described later.

Figure 4A:
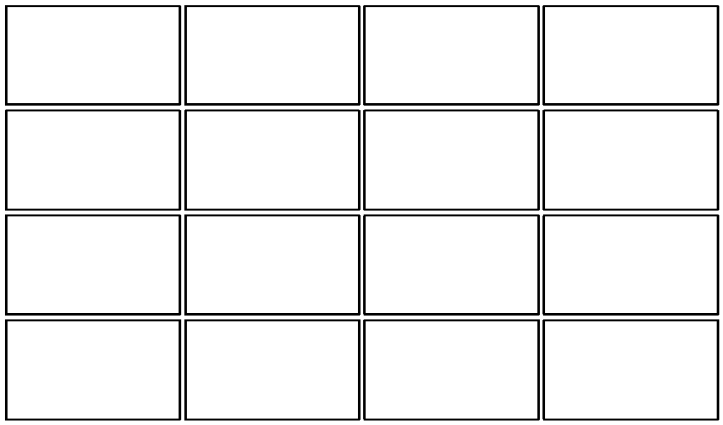
FIGS. 4A to 4C illustrate how marks to be displayed are changed in accordance with modes.
Figure 4B:
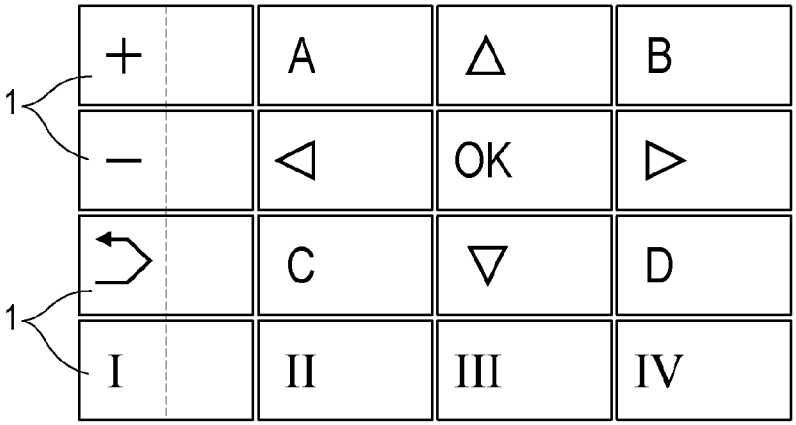
Figure 4C:
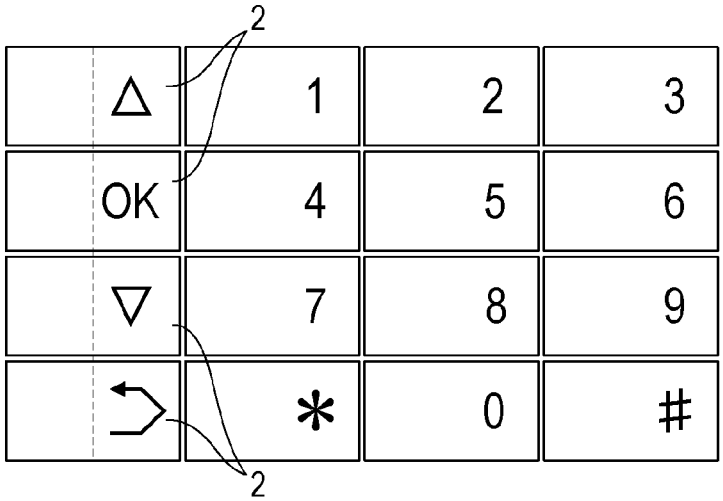

FIGS. 4A to 4C illustrate how the display of the switch array portion 10 is changed in accordance with the mode.

FIG. 4A illustrates displays on the buttons when the power is turned off. When the power is turned off, an input using any buttons is disabled. In response to this state, the displays of all buttons are turned off. This allows the operator to recognize that an input using any of the buttons is disabled. FIG. 4B illustrates displays on the buttons when the COPY mode, the SCAN mode, or the CARD mode is set. In the two display portions 1 and 2 of each of the buttons, the back-light source of the display portion 1 on the left is turned on so as to display a mark on the left, and the back-light source of the display portion 2 on the right is turned off so as not to display a mark on the right. The display states of all of the COPY, SCAN, and CARD modes are not necessarily the same. Light sources of unnecessary buttons can be turned off in accordance with the mode. FIG. 4C illustrates displays on the buttons when the FAX mode is set. In the two display portions 1 and 2 of each of the buttons, the back-light source of the display portion 2 on the right is turned on so as to display a mark on the right, and the back-light source of the display portion 1 on the left is turned off so as not to display a mark on the left. This allows the operator to recognize the function of each button in accordance with the set mode.

Figure 5A:
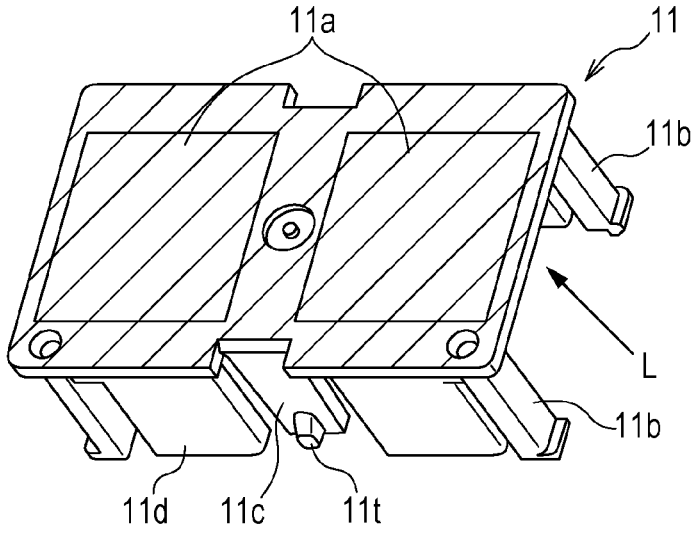
FIGS. 5A to 5C illustrate an exploded view of a pressing portion, in which three components included in the pressing portion are illustrated.
Figure 5B:
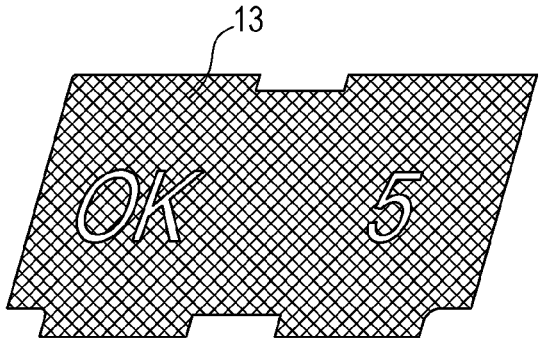
Figure 5C:
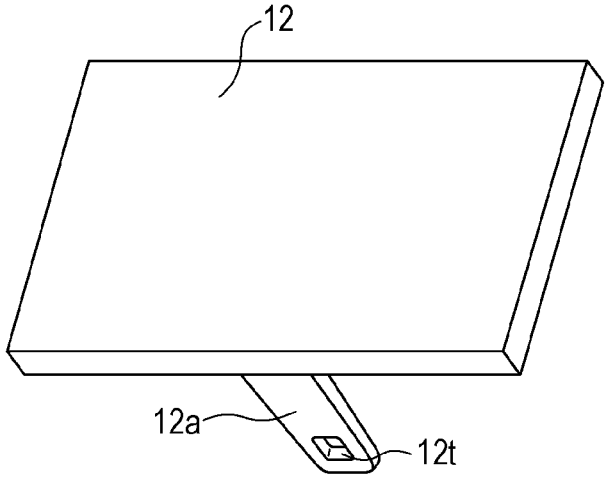
Figure 6A:
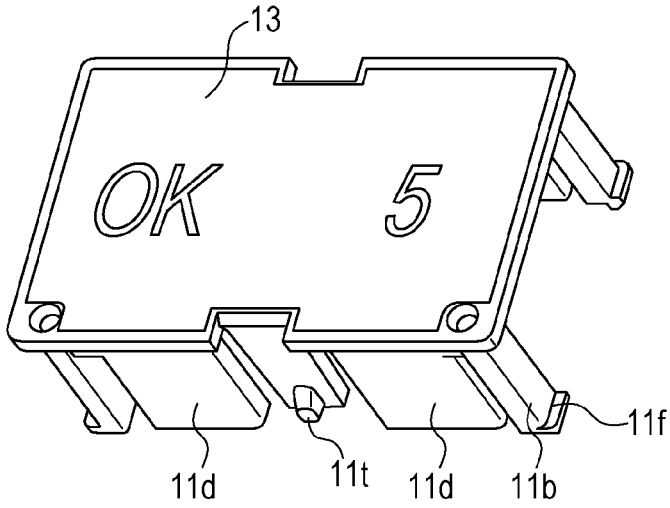
FIGS. 6A to 6C are diagrams for explaining a procedure of assembling the three components of the pressing portion together.
Figure 6B:
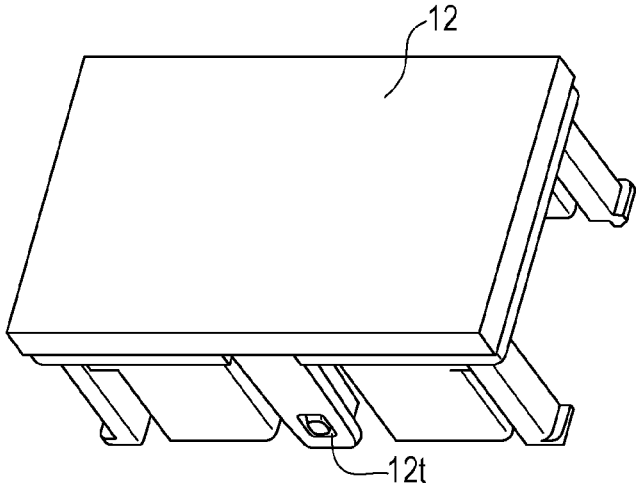
Figure 6C:
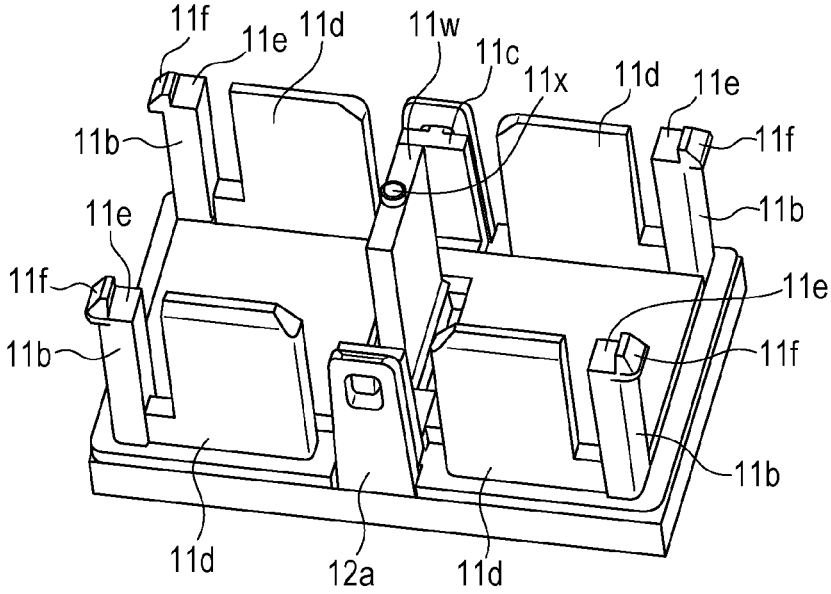

Next, the details of the switch structure of each of the buttons in the switch array portion 10 will be described. FIGS. 5A to 5C illustrate an exploded view of the pressing portion, in which three components included in the pressing portion, which is one of components of the button, are illustrated. FIGS. 6A to 6C are diagrams for explaining a procedure of assembling the three components together.

As illustrated in FIGS. 5A to 5C, each pressing portion includes three components, that is, a key frame 11 (FIG. 5A), a film 13 (FIG. 5B), and a key top 12 (FIG. 5C).

Referring to FIGS. 5A and 6C, the key frame 11 includes a light guide portion 11*a* embedded into a frame structure thereof. The light guide portion 11*a* passes and diffuses light emitted from the back-light source in a direction indicated by an arrow L from behind. The light guide portion 11*a* serves as a diffusion layer. In a central area of a rear surface of the key frame 11, a plate 11*w* is provided perpendicular to the rear surface of the key frame 11 (i.e., a plane parallel with the rear surface of the key frame 11) so as to separate the left and right display portions 1 and 2. At the center of a lower end of the plate 11*w*, a protrusion-shaped contact portion 11*x* is formed. The contact portion 11*x* contacts a push switch, which will be described later. Four legs 11*b*, which extend parallel to the plate 11*w*, are each formed at a corresponding one of four corners of the rear surface of the key frame 11. Each of the legs 11*b* has a contact portion 11*e* and a nail 11*f* at a free end (a lower end) thereof. The contact portion 11*e* contacts an elastic portion, which will be described later, and the nail 11*f* is to be latched to a holder. Furthermore, on the rear surface of the key frame 11, two legs 11*c* and four side walls 11*d* are formed perpendicular to the rear surface of the key frame 11. The legs 11*c* are formed across the plate 11*w* from each other. The side walls 11*d* each have a surface that is perpendicular to the plate 11*w*. Each of the legs 11*c* has a protrusion 11*t* formed near a free end (lower end) thereof. All the components of the key frame 11 except for the light guide portion 11*a* are black-colored resin members having a light shielding property that blocks light. The key frame 11 except for the light guide portion 11*a*, the plate 11*w*, the legs 11*b*, the legs 11*c*, and the side walls 11*d* are integrally formed into a single unit using resin molding. The light guide portion 11*a* is attached to an opening of the key frame 11 formed using resin molding. It is sufficient that the light guide portion 11*a* is made to pass and diffuse light. The light guide portion 11*a* can be formed of a transparent resin material, the front surface of which is satin finished.

Referring to FIG. 5B, the film 13 has light shielding areas that are formed using printing on one of surfaces of a thin plate-shaped transparent base material thereof. The film 13 serves as a mark layer on which mark patterns to be displayed is formed. In order to form mark patterns, silk-screen printing is desirable. In silk-screen printing, ink is applied to areas of a transparent base material except areas where marks are to be formed. In an example illustrated in FIG. 5B, characters "OK" and "5" are respectively formed on the left and right sides as transparent areas. In order to produce such a film 13, stencil printing is performed on a rear surface side of the transparent base material so as to apply ink to areas except for the transparent areas. The marks can be directly printed on the light guide portion 11*a* of the key frame 11 instead of using the film 13.

Referring to FIG. 5C, the key top 12 is formed of an opaque white semi-transparent material or a gray smoke-colored clear semi-transparent resin material having a low light transmittance so as to reflect environmental illumination at a front surface thereof. The key top 12 serves as a semi-transparent layer. The light transmittance of the key top 12 is, for example, 10%. The key top 12 can be a semi-transparent member formed of clear resin with the front surface thereof processed to be a half-mirror. Two legs 12*a* are formed on a rear surface of the key top 12. A hole 12*t* is formed near a free end (lower end) of each of the legs 12*a*. The operator presses the front surface of the key top 12 by a finger to press down the surface of the key top 12 in order to perform a switch input.

The procedure of assembling the three components together will be described below with reference to FIGS. 6A to 6C. As illustrated in FIG. 6A, the film 13 is initially positioned relative to the key frame 11 and bonded to the key frame 11. Then, as illustrated FIGS. 6B and 6C, the key top 12 is placed over the key frame 11, to which the film 13 has been bonded, such that the protrusion 11*t* formed on each of the two legs 11*c* of the key frame 11 is engaged with and latched to a corresponding one of the holes 12*t* formed in the legs 12*a* of the key top 12. This latch mechanism prevents the key top 12 from being easily removed from the key frame 11 during operation. FIG. 6C illustrates the engaged state illustrated in FIG. 6B seen from the rear surface side thereof.

With the above-described structure, light emitted from the back-light source is diffused by the diffusion layer, passes through the transparent areas of the film 13 and the key top 12, which is a semi-transparent layer, and is visually recognized by the operator. Since the light transmittance of the key top 12 is small, the display portion 1 or 2 that is not illuminated is almost visually unrecognizable to the operator. When outside light enters the key top 12 from the key top 12 side, the light passes through the key top 12, is reflected by the film 13, passes again through the key top 12, and exits. By passing through the key top 12 having a small light transmittance twice in a to-and-fro travel, the light is significantly attenuated. For example, when the light transmittance of the key top 12 is 10%, the amount of light is attenuated down to one hundredth of the original amount after the light has passed through the key top 12 twice. Thus, with outside light in an environment that is generally assumed, it is almost impossible for the operator to visually recognize the marks.

The film 13 is set such that the printed surface thereof faces downward so as to oppose the light guide portion 11*a* of the key frame 11. By doing this, light emitted from the light source is blocked by the light shielding areas in the printed surface before the light enters the transparent base material of the film 13. This can improve contrast in displaying the marks, thereby realizing a desirable visibility of the marks with which the operator recognizes the marks. Assume that the film 13 is set such that the printed surface thereof faces upward so as to oppose the key top 12. In this case, light emitted from the light source enters the transparent base material of the film 13, and then blocked by the light shielding areas printed on the front surface. At this time, the light is irregularly reflected by the light shielding areas, and the reflected light passes again through the transparent base material. This causes an edge of an outer periphery of the film 13 to be illuminated. This means degradation in the visibility of the marks for the operator.

Figure 7A:
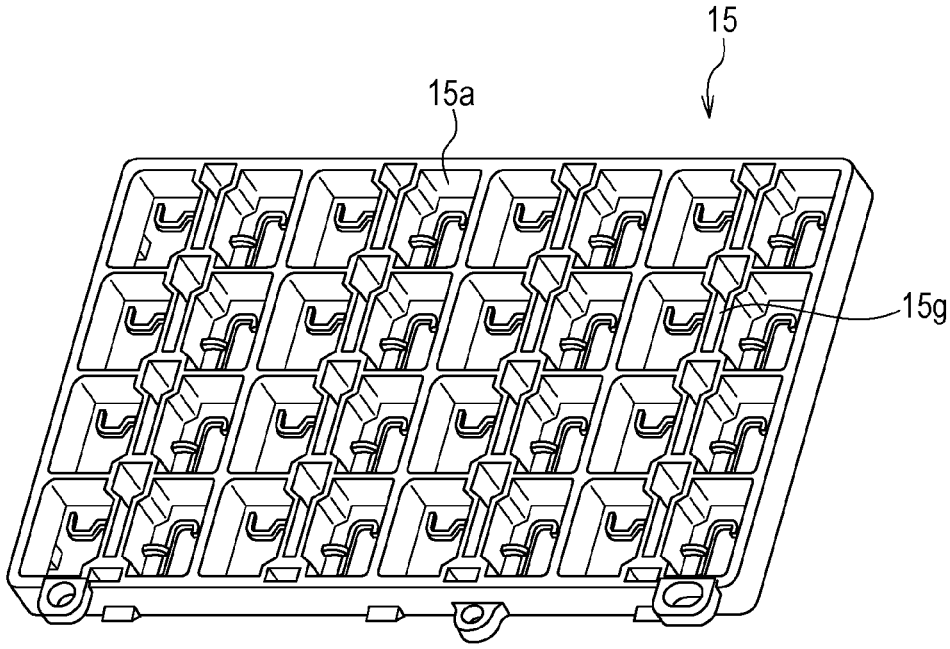
FIGS. 7A and 7B illustrate the structure of a holder.
Figure 7B:
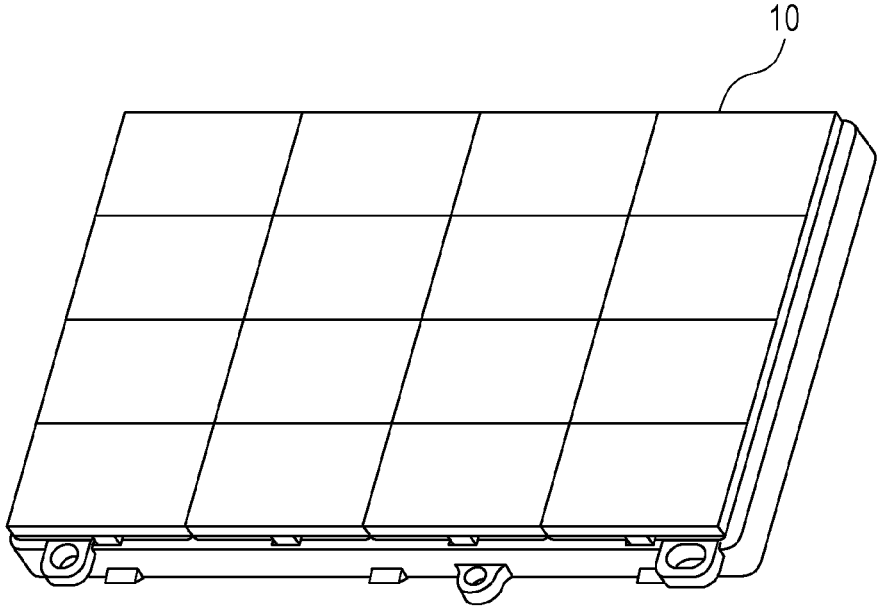

FIGS. 7A and 7B are perspective views illustrating the structure of a holder 15 that is part of the switch array portion 10. FIG. 7A illustrates an internal structure of the holder 15. The holder 15 has a plurality of rectangular cells arranged in a four by four array shape. Walls having a light shielding property separate the cells from the adjacent cells. Each cell has a thin elastic portion 15*a* therein formed of a resin spring. Each elastic portion 15*a* is integrally molded with the holder 15 using the same resin material. The elastic portion 15*a* is not limited to a resin spring integrally molded with the holder 15. The elastic portion 15*a* having an elastic body can be separately formed from the holder 15. A regulation portion 15*g* is formed in each of the cells so as to cross the cell. Each of the regulation portions 15*g* has two regulation surfaces. Sides of the two regulation surfaces are secured to two inner walls that oppose each other in the second direction of each cell. The plate 11*w* is interposed between the two regulation surfaces.

Each of the pressing portions having the above-described structure is inserted into a space of a corresponding one of the plurality of cells such that the pressing portion is movable in a specified stroke in the third direction (up-down direction). FIG. 7B illustrates a state of the switch array portion 10 in which the pressing portions are inserted into the plurality of cells formed in the holder 15.

Figure 8A:
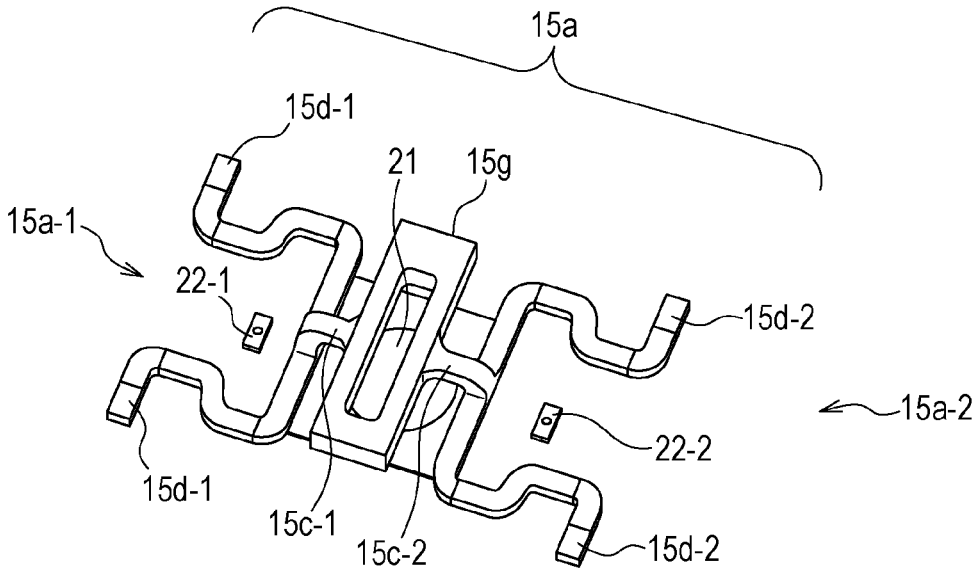
FIGS. 8A and 8B are diagrams for explaining the inner structure of a cell.
Figure 8B:
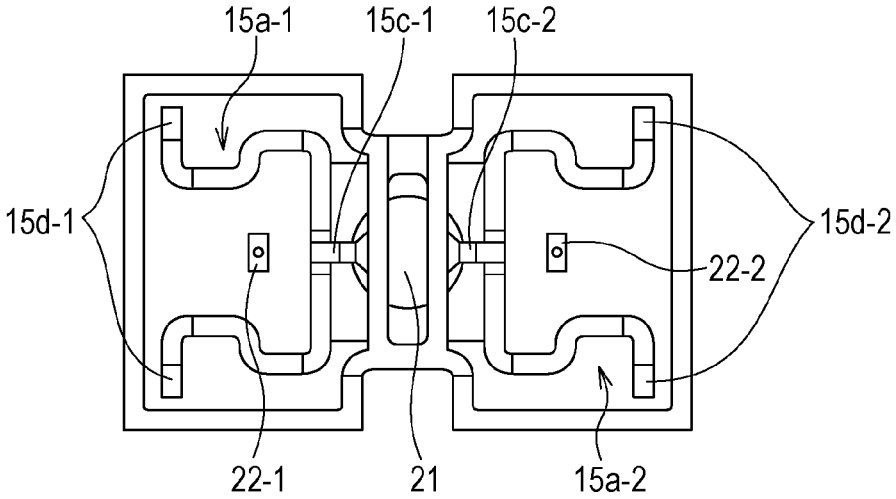

FIGS. 8A and 8B are respectively a perspective view and a top view that illustrate the structure of the elastic portion 15*a* and the regulation portion 15*g* in one of the cells with respect to the light sources and a push switch 21.

The regulation portion 15*g* has an opening in a central area thereof. The plate 11*w* of the key frame 11 is inserted into this opening of the regulation portion 15*g*. The center of the opening is positioned rightly above a top portion of the push switch 21. When a force that causes the key frame 11 to move or incline is applied in the first direction, an inner wall of the opening of the regulation portion 15*g* contacts the plate 11*w* in order to regulate movement or inclination of the plate 11*w*. In the second direction, each end of the regulation portion 15*g* is firmly secured to a corresponding one of the inner walls of the cell that oppose each other in the second direction. In the present embodiment, the holder 15 and each of the regulation portion 15*g* are formed to be an integrated unit using resin molding. The regulation portion 15*g* has the following functions. That is, a function of suppressing inclination of the key frame 11, a function of preventing light from leaking to adjacent spaces, and a function of reinforcing the strength of the cell and the strength of the entire holder 15.

The elastic portion 15*a* is formed in the cell so as not to block light from a first light source 22-1 and a second light source 22-2. The elastic portion 15*a* has a first elastic portion 15*a*-1 and a second elastic portion 15*a*-2. In the first elastic portion 15*a*-1, a secured end 15*c*-1 is attached to one of the sides of the regulation portion 15*g* and formed so as to surround part of an area around the first light source 22-1. In the second elastic portion 15*a*-2, a secured end 15*c*-2 is attached to the other side of the regulation portion 15*g* and formed so as to surround part of an area around the second light source 22-2. That is, as illustrated in FIGS. 8A and 8B, the first elastic portion 15*a*-1 and the second elastic portion 15*a*-2 each have a curved-line shape similar to the shape of Ω (ohm). The central portions of the first elastic portion 15*a*-1 and the second elastic portion 15*a*-2 are secured to the regulation portion 15*g* through the secured end 15*c*-1 and the secured end 15*c*-2, respectively. The curved-line shape of the first elastic portion 15*a*-1 surrounds part of the area around the first light source 22-1, and the curved-line shape of the second elastic portion 15*a*-2 surrounds part of the area around the second light source 22-2 seen from above. These curved-line shapes are formed so as not to block rays of light emitted from the first and second light sources 22-1 and 22-2, respectively. The first elastic portion 15*a*-1 and the second elastic portion 15*a*-2 are each formed of, for example, a plastic and have a thickness of about 0.5 to 3.0 mm in the third direction.

The first elastic portion 15*a*-1 has two free ends 15*d*-1 at ends of portions thereof that branch and extend from the secured end 15*c*-1. Each of the free ends 15*d*-1 contacts a corresponding one of the contact portions 11*e* of the two legs 11*b* formed on the display portion 1 side out of the four legs 11*b* of the pressing portion. The second elastic portion 15*a*-2 has two free ends 15*d*-2 at ends of portions thereof that branch and extend from the secured end 15*c*-2. Each of the free ends 15*d*-2 contacts a corresponding one of the contact portions 11*e* of the two legs 11*b* formed on the display portion 2 side out of the four legs 11*b*. In the first elastic portion 15*a*-1 and the second elastic portion 15*a*-2, resin springs, each of which is formed to have a thin elongated shape, entirely undergo elastic deformation, thereby allowing the free ends 15*d*-1 and the free ends 15*d*-2 to move through in a moving stroke in a specified range mainly in the third direction. That is, the first elastic portion 15*a*-1 and the second elastic portion 15*a*-2 are entirely flexibly displaced so as to function as springs in a range of the specified moving stroke in the third direction without occurrence of cracks or bends.

Figure 9A:
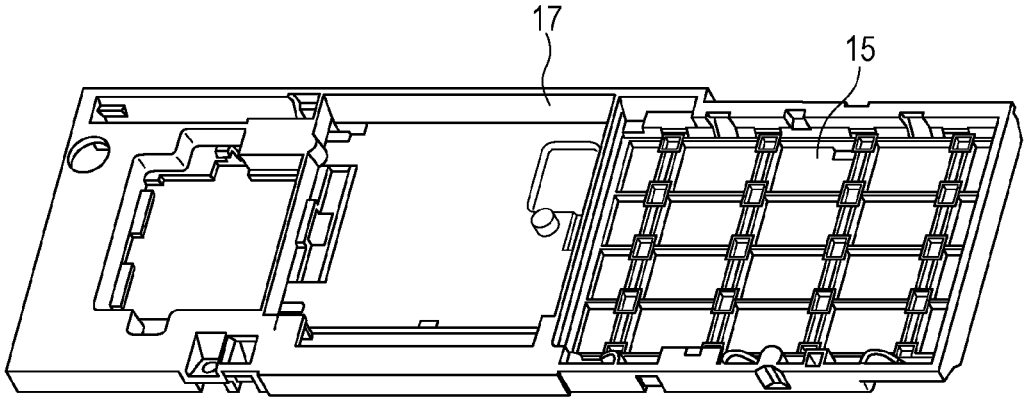
FIGS. 9A and 9B are perspective views respectively illustrate a frame of the operation panel and an electrical circuit board of the operation panel.

The holder 15 is secured to a frame of the operation panel 70. A circuit board that processes signals is provided below the holder 15. FIG. 9A illustrates the structure of a panel frame 17 of the operation panel 70. The holder 15 is mounted in and secured to the panel frame 17. By preparing the holder 15 as a component separated from the panel frame 17, the holder 15 can be detached in order to perform tasks such as replacement of the film 13. This improves work efficiency. The panel frame 17 and the holder 15 can be integrated into a unit.

Figure 9B:
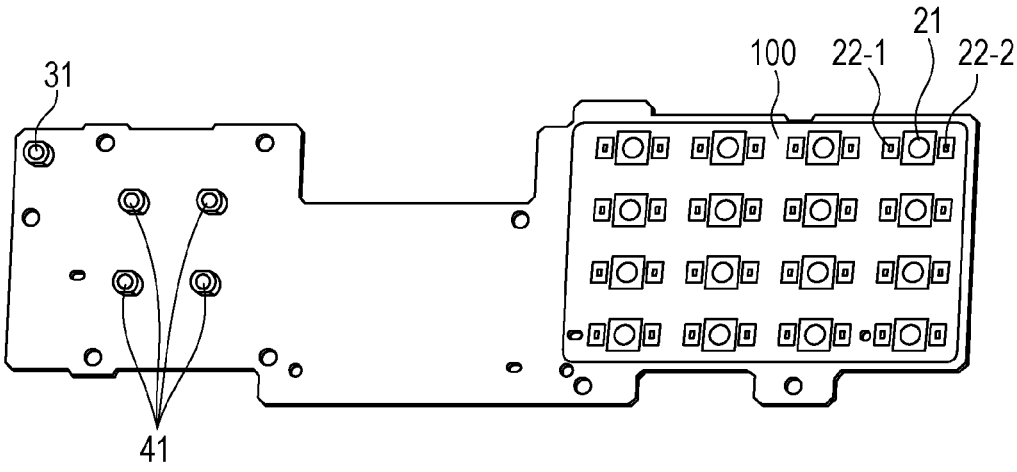

FIG. 9B illustrates the structure of a circuit board 100. The push switches 21, the first light sources 22-1, and the second light sources 22-2 are mounted on the circuit board 100 using soldering at positions corresponding to that of a plurality of cells of the holder 15. Each of the first light sources 22-1 and each of the second light sources 22-2 are disposed on the one side and the other side of a corresponding one of the push switches 21. The push switches 21 are mechanical switches, each of which is turned on by a pressing force from above. In the present embodiment, the push switches 21 use thin metal dorm switches. A compact semiconductor light sources such as LEDs are desirably used for the first and second light sources 22-1 and 22-2. A mechanical switch 31, which corresponds to the power switch 30, and four mechanical switches 41, which correspond to the mode switch 20, are also mounted on the circuit board 100. In the present embodiment, tactile switches are used for the mechanical switches 31 and 41.

Figure 10A:
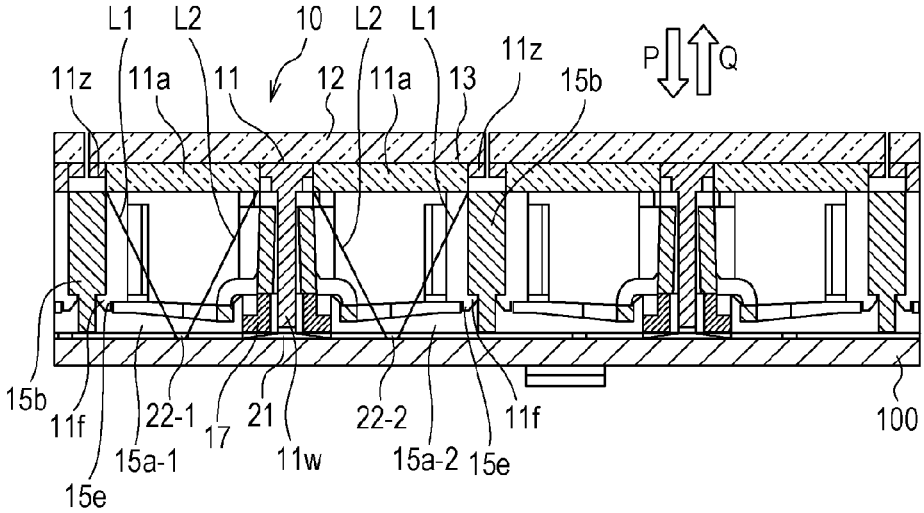
FIGS. 10A and 10B illustrate a state in which the pressing portion and the holder are combined together.
Figure 10B:
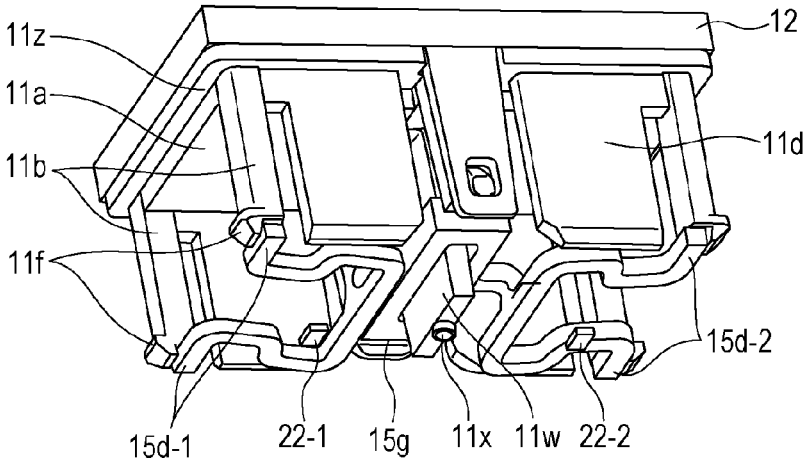

FIGS. 10A and 10B illustrate an assembled state of part of the switch array portion 10. Specifically, FIG. 10A is a sectional view seen from a side of part of the switch array portion 10, and FIG. 10B is a perspective view illustrating a state in which the pressing portion and the holder 15 are combined together in one of the cells.

When the plate 11*w* of the key frame 11 is inserted into the opening of the regulation portion 15*g*, the contact portion 11*x* formed at the lower end of the plate 11*w* is exposed at a lower position and positioned rightly above a corresponding one of the push switches 21. In addition, the lower ends of the four legs 11*b* of the key frame 11 each contact a corresponding one of the four free ends 15*d*-1 and 15*d*-2 of the elastic portion 15*a*. That is, each of the two free ends 15*d*-1 of the first elastic portion 15*a*-1 contacts a corresponding one of the contact portions 11*e* of the two legs 11*b*, which are formed on the display portion 1 side, out of the four legs 11*b* of the pressing portion. Each of the two free ends 15*d*-2 of the second elastic portion 15*a*-2 contacts a corresponding one of the contact portions 11*e* of the two legs 11*b*, which are formed on the display portion 2 side, out of the four legs 11*b*.

When the operator presses the pressing portion in an arrow P direction with a finger, the top portion of the push switch 21 is pressed by the contact portion 11*x* of the plate 11*w*, thereby turning on the push switch 21 on. In so doing, the first elastic portion 15*a*-1 and the second elastic portion 15*a*-2 elastically deform so as to displace the free ends 15*d*-1 and the free ends 15*d*-2 downward in the third direction. As a result, an elastic force is applied to the elastic portion 15*a* as a restoration force that pushes back the pressing portion in an arrow Q direction. Since the restoration force is uniformly applied to four corners of the pressing portion, the pressing portion is pushed back without being inclined, thereby allowing a sensation of a smooth pressing operation of a switch to be obtained. The elastic portion 15*a* is formed to have a shape with which a switch input can be performed even with a small amount of pressing, and an elastic force that can ensure a restoration force required to push back the pressing portion can be obtained. The first and second elastic portions 15*a*-1 and 15*a*-2 extend from the secured ends 15*c*-1 and 15*c*-2 by a considerable length and have the free ends 15*d*-1 and 15*d*-2 at the ends of the extended portions. Thus, when the free ends 15*d*-1 and 15*d*-2 are pressed, the entirety of the elastic portion 15*a* gently bends, thereby allowing a sensation of a smooth pressing operation to be obtained.

The outwardly faced nails 11*f* are formed at the lower ends of the legs 11*b* of the key frame 11. When the key frame 11 is inserted into the cell, the nails 11*f* are latched to corresponding engaging portions 15*e* that are formed in the holder 15. The key frame 11 having been mounted using this latch mechanism is not easily removed in the arrow Q direction. The elastic portion 15*a* continues to urge the key frame 11 in the arrow Q direction even after the nails 11*f* of the key frame 11 have been latched. By forming the engaging portions 15*e* for all the 16 switches included in the switch array portion 10 at the same height, the upper surfaces of the key tops 12 can be aligned to a flat plane.

As described above, the regulation portion 15*g* has two regulation surfaces. The plate 11*w* is interposed between the two regulation surfaces in the cell in a contactless manner. The key frame 11 of the pressing portion has the four side walls 11*d*. The plate 11*w* and the regulation portion 15*g* regulate movement and inclination relative to the cell of the key frame 11 in the first direction (lateral direction), and the inner walls that oppose each other in the second direction (lengthwise direction) of the cell and the side walls 11*d* regulate movement and inclination in the second direction. Thus, even when the operator pushes a position shifted from the center of the key top 12, a large inclination of the key frame 11 in the first or second direction is prevented from occurring. Thus, a reliable switch input is realized. Since a combined area of the display portions 1 and 2 has a rectangular shape, of which the length in the first direction is longer than that in the second direction. Thus, the operator tends to press a position of the key top 12 on a side where a mark is displayed. That is, a force that causes inclination is generated more easily in the first direction than in the second direction. Even when such a force is generated, the plate 11*w* and the regulation portion 15*g* effectively suppress occurrence of inclination. Thus, a highly reliable switch device is realized.

In order to prevent an increase in resistance against depressing, gaps are formed between surfaces of the plate 11*w* and the regulation surfaces of the regulation portion 15*g*. For this reason, when the operator pushes the key top 12 at an off-center position, a slight inclination occurs although the degree of this inclination is not so large as to destabilize the switch input. Even when the key top 12 and the plate 11*w* are inclined as described above, the four legs 11*b* receive a spring-like repulsive force from the free ends 15*d*-1 and 15*d*-2 of the elastic portion 15*a* in a direction in which the inclination is canceled. Thus, the sensation of a smooth pressing operation is not degraded.

In order not to block light emitted from the first and second light sources 22-1 and 22-2, the elastic portion 15*a* is formed so as to surround the areas around the first and second light sources 22-1 and 22-2. Thus, rays of light from the first and second light sources 22-1 and 22-2 are respectively used to illuminate the display portions 1 and 2 without wastage of light. Thus, the marks are displayed using light having high intensity. In addition, since the key top 12 having a low light transparency is provided, the marks of the display portions 1 and 2 that are not illuminated are not easily visually recognized even when light from lighting in a room or natural light is incident upon the key top 12.

In each of the cells, the plate 11*w* formed with the pressing portion is positioned so as to separate a first space and a second space. The first space is defined between the first light source 22-1 and the display portion 1, and the second space is defined between the second light source 22-2 and the display portion 2. The regulation portion 15*g* is also positioned between the first space and the second space. Both the plate 11*w* and the regulation portion 15*g* are formed as members having a light shielding property. In each of the cell, this suppresses leakage of light from the first light source 22-1 to the display portion 2 and leakage of light from the second light source 22-2 to the display portion 1. Thus, when one of the display portions 1 and 2 is illuminated and the other one of the display portions 1 and 2 is not illuminated, a situation in which one of the display portions 1 and 2 that is not illuminated dimly lights is suppressed. As a result, the operator can correctly recognize the functions of the buttons. Since the walls that separate the cells of the holder 15 are also formed as members having a light shielding property, leakage of light between the adjacent cells is suppressed.

Fine gaps are formed on borders between the adjacent key tops 12 that are arranged in an array shape. If light from the first light source 22-1 or the second light source 22-2 leaks through these gaps, portions that are desirably not illuminated are illuminated. A design that prevents this situation from occurring is described below. Referring to FIG. 10A, rays of light emitted from the first light source 22-1 and the second light source 22-2 are incident upon the light guide portion 11*a* in ranges defined by edge lines of an upper frame of the holder 15 (ranges defined between lines L1 and L2), and the rays of light outside those ranges are blocked by surfaces of inner walls of the holder 15. Out of the rays of light that are incident upon the light guide portion 11*a*, rays of light having traveled in lines L1 pass through the light guide portion 11*a* that passes and diffuses light, and enter spaces between a lower surface of the key top 12 and upper surfaces of a light shielding walls 15*b*. Rays of light that travel in lines L2 are blocked by the wall surfaces of the plate 11*w* and do not enter the adjacent display portions 1 and 2. These spaces are formed in order to allow the key top 12 to be pressed down in a specified stroke. Since the gaps between the key tops 12 are formed above this space, if a measure is not taken, there is a possibility of light having entered the spaces leaking to external areas through the gaps. A frame ends 11*z* of the key frame 11, which are positioned above the shielding walls 15*b* and below the key top 12 in these spaces, prevent this leakage of light. That is, the frame ends 11*z* serving as light shielding members are each positioned on an extended line of a corresponding one of line L1. The frame ends 11*z* block the light having passed through the light guide portion 11*a* and enters these spaces. Thus, leakage of light to external areas through the gaps is prevented. By doing this, leakage of light between the adjacent cells is reliably suppressed using portions of the key frame 11 positioned above the shielding walls 15*b*, and accordingly, leaked light is not visually recognized by the operator.

In addition, the frame ends 11*z* also serve as regulation members that contact, when the key top 12 is pressed down, the upper surfaces of the shielding walls 15*b* in order to regulate a specified moving stroke, with which the key top 12 is prevented from being further pressed down. That is, the frame end 11*z* is formed as a component that has two functions: a function of regulating a moving stroke and a function of shielding light.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-286529 filed Dec. 22, 2010, which is hereby incorporated by reference herein in its entirety.

What is claimed is:

1. A switch device comprising:

a pressing portion having a first display portion and a second display portion;

a holder having at least one cell corresponding to the pressing portion;

a push switch;

first and second light sources that respectively illuminate the first display portion and the second display portion from behind;

a plate formed with the pressing portion so as to separate, in a cell, a space between the first light source and the first display portion from a space between the second light source and the second display portion; and a regulation portion formed on both sides of the plate in the cell, wherein, when the pressing portion is pressed, a portion of the plate presses the push switch.

2. The switch device according to claim 1, wherein the pressing portion has four legs at four corners thereof, the four legs each extending in a direction parallel to the plate, wherein an elastic portion is formed in the cell so as not to block light from the first and second light sources, wherein the elastic portion has contact portions that each contact a corresponding end portion of the four legs, wherein, when the pressing portion is pressed, a restoration force is applied to each of the four legs in a direction so the pressing portion is pushed back from the elastic portion.

3. The switch device according to claim 2, wherein the elastic portion having a first elastic portion and a second elastic portion, the first elastic portion having a secured end attached to the regulation portion to surround part of an area around the first light source, the second elastic portion having a secured end attached to the regulation portion to surround part of an area around the second light source, wherein the first elastic portion has two free ends proximate ends of portions thereof that branch and extend from the secured end, each of the free ends contacting a corresponding one of the end portions of the two legs formed on the first display portion side out of the four legs, wherein the second elastic portion has two free ends proximate ends of portions thereof that branch and extend from the secured end, each of the free ends contacting a corresponding one of the end portions of the two legs formed on the second display portion side out of the four legs.

4. The switch device according to claim 2, wherein a nail is formed on an end of each leg, the nail latched to an engaging portion of the holder when the switch device is mounted in the holder.

5. The switch device according to claim 1, wherein the plate and regulation portion each function as a light shielding member.

6. The switch device according to claim 5, wherein the regulation portion is secured to two opposing inner walls of the cell, the regulation portion having two regulation surfaces with the plate being interposed between the two regulation surfaces.

7. The switch device according to claim 1, wherein the first display portion and the second display portion are provided with a diffusion layer that passes and diffuses light, a mark layer that is stacked on the diffusion layer and has a mark pattern formed of transparent and light shielding areas, and a semi-transparent key top that is stacked on the mark layer, wherein light from each of the first light source and the second light source is diffused by the diffusion layer, passes through the transparent area of the mark layer and the key top, and is visually recognized by an operator.

8. The switch device according to claim 7, wherein ink is applied to part of a surface of a transparent base material on the diffusion layer side by printing so as to form the light shielding area of the mark layer, in forming the mark layer.

9. The switch device according to claim 7, wherein the key top is formed of a smoke-colored clear resin material, or formed of a clear resin material that has a surface processed to be a half-mirror, wherein the key top is removably mounted on the mark layer and the diffusion layer using a latch mechanism.

10. The switch device according to claim 1, wherein the pressing portion has a side wall, wherein the plate and the regulation portion regulate movement and inclination of the pressing portion relative to the cell in a first direction, wherein the side wall and an inner wall of the cell regulate movement and inclination of the pressing portion relative to the cell in a second direction.

11. The switch device according to claim 1, wherein the holder has a structure in which the plurality of rectangular-shaped cells are arranged in an array shape, the plurality of cells each being separated from the adjacent cell using a wall having a light shielding property, wherein each of the plurality of cells is provided with the corresponding pressing portion.

12. The switch device according to claim 11, wherein the pressing portion has a portion that contacts an upper surface of the wall when the pressing portion is pressed down, wherein the portion of the pressing portion is disposed at a position at which the portion of the pressing portion blocks light so as to prevent the light from passing above the wall and leaked through a gap formed between adjacent cells, the light emitted from the first light source or the second light source.

13. An electronic apparatus comprising:

the device according to claim 1.

* * * * *